US009339776B2

(12) United States Patent
Eggler et al.

(10) Patent No.: US 9,339,776 B2
(45) Date of Patent: May 17, 2016

(54) STIRRING INSTALLATION AND METHOD

(75) Inventors: Thomas Eggler, Rothrist (CH); Angelo Cadeo, Oftringen (CH)

(73) Assignee: Miteco AG, Zofingen (CH)

( * ) Notice: Subject to any disclaimer, the term of this patent is extended or adjusted under 35 U.S.C. 154(b) by 441 days.

(21) Appl. No.: 13/990,052

(22) PCT Filed: Nov. 30, 2010

(86) PCT No.: PCT/CH2010/000304
§ 371 (c)(1),
(2), (4) Date: Jun. 11, 2013

(87) PCT Pub. No.: WO2012/071673
PCT Pub. Date: Jun. 7, 2012

(65) Prior Publication Data

US 2013/0279289 A1 Oct. 24, 2013

(51) Int. Cl.
*B01F 7/00* (2006.01)
*B01F 13/00* (2006.01)

(52) U.S. Cl.
CPC ..... *B01F 7/00091* (2013.01); *B01F 7/00066* (2013.01); *B01F 7/00558* (2013.01); *B01F 13/0018* (2013.01); *B01F 13/0032* (2013.01); *B01F 2215/0022* (2013.01)

(58) Field of Classification Search
CPC ..... B01F 7/00075; B01F 7/00066; B01F 7/00091; B01F 7/00558
USPC ..... 366/308, 241, 242, 244, 255, 285, 129
See application file for complete search history.

(56) References Cited

U.S. PATENT DOCUMENTS

| | | | | | |
|---|---|---|---|---|---|
| 364,059 | A | * | 5/1887 | Stauffert | 366/285 |
| 579,055 | A | * | 3/1897 | Gates | 366/308 |
| 1,227,671 | A | * | 5/1917 | Kolllenberg | 366/197 |
| 1,399,513 | A | * | 12/1921 | Nyberg | 366/284 |
| 1,436,172 | A | * | 11/1922 | Holmgren et al. | 366/251 |
| 2,228,421 | A | * | 1/1941 | Taylor | 222/228 |
| 2,561,258 | A | * | 7/1951 | Wolf et al. | 222/406 |
| 2,595,793 | A | * | 5/1952 | Kay | 366/276 |
| 2,609,185 | A | * | 9/1952 | Eisner | 366/102 |
| 3,138,300 | A | * | 6/1964 | Rintala | 222/228 |

(Continued)

FOREIGN PATENT DOCUMENTS

| | | |
|---|---|---|
| DE | 37 25 977 A1 | 2/1989 |
| FR | 1 479 166 A | 4/1967 |

OTHER PUBLICATIONS

International Search Report of PCT/CH2010/000304, Nov. 30, 2011 Form PCT/ISA/210, total 5 pages.

*Primary Examiner* — Tony G Soohoo
(74) *Attorney, Agent, or Firm* — Collard & Roe, P.C.

(57) ABSTRACT

The invention relates to a stirring installation (1) for stirring a liquid and/or a paste in a container (10), comprising an actuating means (5) arranged outside the container (10) and a stirring means (2, 8, 9) arranged inside the container (10) comprising at least two blades (2). The stirring means (2, 8, 9) is rotatably coupled to the actuating means (5) by a coupling element (3), in such a way that the blades (2) are movably attached with a first end to at least a bearing (4) of the coupling element (3). During a rotation of the coupling element (3), the blades (2) are pivotable around the bearing (4) due to the influence of the centrifugal force. Furthermore, the invention relates to a method for stirring a liquid in the container (10) by means of the stirring installation (1).

9 Claims, 2 Drawing Sheets

(56) References Cited

U.S. PATENT DOCUMENTS

| | | | | | |
|---|---|---|---|---|---|
| 3,212,672 | A | * | 10/1965 | Kromhout et al. | 366/196 |
| 3,223,290 | A | * | 12/1965 | Schuld | 366/186 |
| 3,223,389 | A | * | 12/1965 | Simmonds | 366/282 |
| 3,381,941 | A | * | 5/1968 | Gibson et al. | 366/308 |
| 3,381,942 | A | * | 5/1968 | Wood | 366/325.1 |
| 3,392,922 | A | * | 7/1968 | Lindgren | 239/658 |
| 3,425,671 | A | * | 2/1969 | Van Der Lely | 422/269 |
| 3,455,540 | A | * | 7/1969 | Marcmann | 416/142 |
| 3,556,413 | A | * | 1/1971 | Lindgren | 239/658 |
| 3,559,962 | A | * | 2/1971 | Enssle et al. | 366/308 |
| 3,828,947 | A | * | 8/1974 | Lepley | 414/324 |
| 4,060,224 | A | * | 11/1977 | Wilson | 366/169.1 |
| 4,083,653 | A | * | 4/1978 | Stiffler | 416/142 |
| 4,396,291 | A | * | 8/1983 | Simmonds | 366/282 |
| 4,451,004 | A | * | 5/1984 | Ostergren et al. | 239/658 |
| 4,561,594 | A | * | 12/1985 | Kampman | 239/658 |
| 4,594,745 | A | * | 6/1986 | Pierce | 15/92 |
| 4,872,764 | A | * | 10/1989 | McClean | 366/251 |
| 4,957,404 | A | * | 9/1990 | Lepley | 414/324 |
| 4,975,013 | A | * | 12/1990 | Lepley | 414/324 |
| 4,981,367 | A | * | 1/1991 | Brazelton | 366/308 |
| 5,192,131 | A | * | 3/1993 | Hatfield | 366/308 |
| 5,411,331 | A | * | 5/1995 | Griffin | 366/286 |
| 5,613,425 | A | * | 3/1997 | Krznaric | 99/348 |
| 5,941,636 | A | * | 8/1999 | Lu | 366/249 |
| 2005/0088907 | A1 | * | 4/2005 | Vanek | 366/129 |
| 2007/0104024 | A1 | * | 5/2007 | Elrod | 366/129 |
| 2013/0279289 | A1 | * | 10/2013 | Eggler et al. | 366/285 |
| 2014/0313853 | A1 | * | 10/2014 | Hughes | 366/293 |

* cited by examiner

STIRRING INSTALLATION AND METHOD

CROSS REFERENCE TO RELATED APPLICATIONS

This application is the National Stage of PCT/CH2010/000304 filed on Nov. 30, 2010, the disclosure of which is incorporated by reference. The international application under PCT article 21(2) was published in English.

TECHNICAL FIELD

The invention is related to a stirring installation and method for mixing liquids and/or pastes, particularly liquids related to the food industry.

BACKGROUND ART

In the food industry, stirring installations are amongst others used during the production of beverages. Beverages are in most cases composed of a plurality of ingredients, that is at least a concentrate and water, for example fruit syrup and water. A production step, which is particularly important in the end phase of production, is to make sure that the end product is homogenous. This step is also important in case an already produced end product that has been stored for a while has to be shipped to consumers. During the storage, the mixed liquid may change its homogeneity due to different viscosities and densities of the ingredients. If the liquid is simply bottled without any treatment, the result may be that each dose has a different taste, consistency, etc. Thus, the liquid has to be made homogenous again. This is accomplished by using stirring installations to remix the liquid. Normally, the liquids are stored in large containers of 500 or 1000 liters. These containers are typically made of plastic by forming them in one piece.

For stirring or mixing a liquid, solutions proposing the usage of a support rod rotated by a motor and having mounted to it at least one pair of blades of the type of a propeller have been provided. A disadvantage of these solutions is the fact that, when the product level in the container is as low as substantially the rotation plane of the blades, the blades "flap" during their rotation and introduce air into the product, which is undesired and which again may lead to an inhomogeneous product.

DISCLOSURE OF THE INVENTION

Hence, it is a general object of the invention to provide an improved stirring installation and method with regard to said disadvantage.

Now, in order to implement this and still further objects of the invention, which will become more readily apparent as the description proceeds, the stirring installation for stirring a liquid and/or a paste in a container comprises an actuating means and a stirring means which is arranged inside the container. The stirring means comprises at least two blades and is rotatably coupled to the actuating means by a coupling element. The coupling is done in such a way that the blades are movably attached with a first end to at least a bearing of the coupling element. During a rotation of the coupling element, the blades are pivotable around the bearing due to the influence of the centrifugal force.

The method for stirring a liquid and/or a paste in a container by means of said stirring installation comprises the steps of:

positioning the stirring installation above the opening of the container, such that the blades of the stirring means hang above the container opening, lowering the stirring means into the container through the opening, actuating the actuating means such that the coupling element starts rotating the hanging blades, increasing the rotation such that the blades start pivoting around the bearing because of an increasing centrifugal force, and stabilizing the rotation speed when the blades have reached a given pivoting angle with respect to a rotation axis.

The advantage of the stirring installation and method is the fact that the blades are always positioned in the pivoting angle with respect to the rotation axis and thus they are always inserted at least partly into the liquid, irrespective of the liquid level inside the container. In other words, the blades are always in an oblique position with respect to the liquid surface. This is due to the fact that they cannot be lifted as high as to be located in the liquid surface plane because of their gravity force. Furthermore, the viscosity of the liquid and/or the stirring requirements limit the maximum rotation speed of the blades, thus also limiting the lifting height of the blades.

BRIEF DESCRIPTION OF THE DRAWINGS

The invention will be better understood and objects other than those set forth above will become apparent when consideration is given to the following detailed description thereof. Such description makes reference to the annexed drawings, wherein.

MODES FOR CARRYING OUT THE INVENTION

Figure 1:
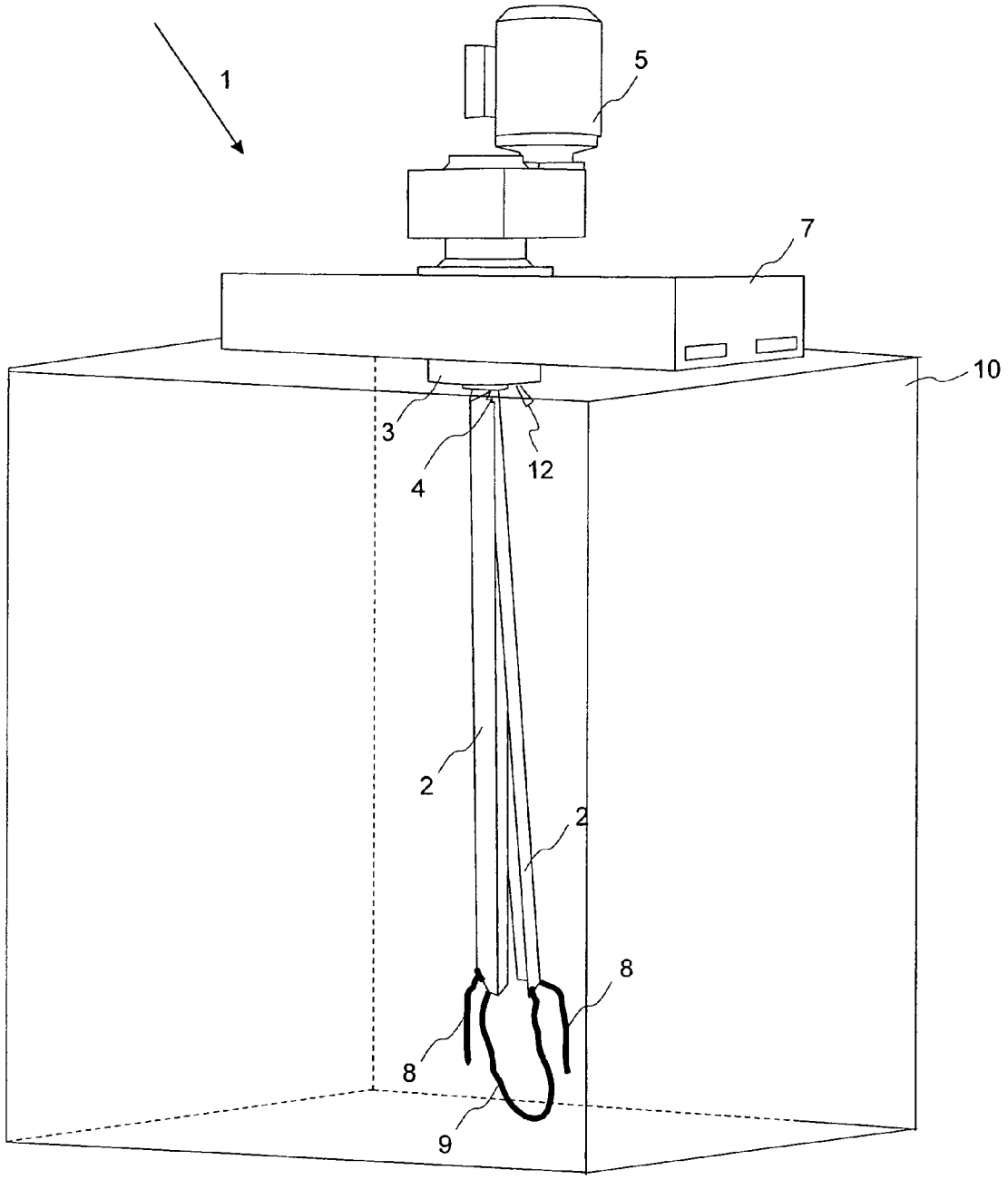
FIG. 1 shows an embodiment of the stirring installation according to the invention in an idle position.

FIG. 1 shows an embodiment of the stirring installation 1 in an idle position. The idle position means that no rotation takes place. The stirring installation 1 comprises an actuating means 5 like for example a motor, a support 7, a coupling element 3 coupling the motor 5 with a stirring means, and additional liquid agitating means 8, 9. The stirring means comprises two blades 2 attached to the coupling element 3 by means of a bearing 4 and is arranged inside a liquid container 10. The bearing 4, which is shown only schematically, may be executed by a screw or the like, which loosely connects the coupling element 3 with the blades 2. The motor is preferably located outside the container; it could however also be located inside or partly inside the container.

The blades 2 have the shape of an angle piece; however they may have a different shape and/or size. They are particularly replaceable with blades 2 of different shape and/or size, such that the stirring installation becomes more flexible with respect to its usage in containers of different sizes.

The liquid agitating means 8, 9 are attached to a second end of at least one of the blades 2. Generally, they comprise at least a side chain 8 with one free end and/or at least a central chain 9 loosely connecting the second ends of two blades 2. In the embodiment of FIG. 1, the agitating means comprise two side chains 8 and one central chain 9. In case there are more than two blades 2, for example three blades 2, a central chain 9 may be attached between each two blades 2, thus increasing the stirring effect at the bottom of the container 10. All chains 8, 9 are made of a suitable material, preferably metal or plastic, which is chosen depending on the density and/or the viscosity of the liquid and which is preferably softer than the material of the liquid container 10 in order to prevent scratches on the bottom of the container 10. As can be seen in FIG. 1, the central chain 9 is loosely connected to the second ends of the blades 2 in order to allow them to spread during rotation. This and the purpose of an abutting member 12 will be explained in more detail in conjunction with FIG. 2. It is noted that other liquid agitating means may be attached to the blades 2, like ribbons, etc.

Figure 2:
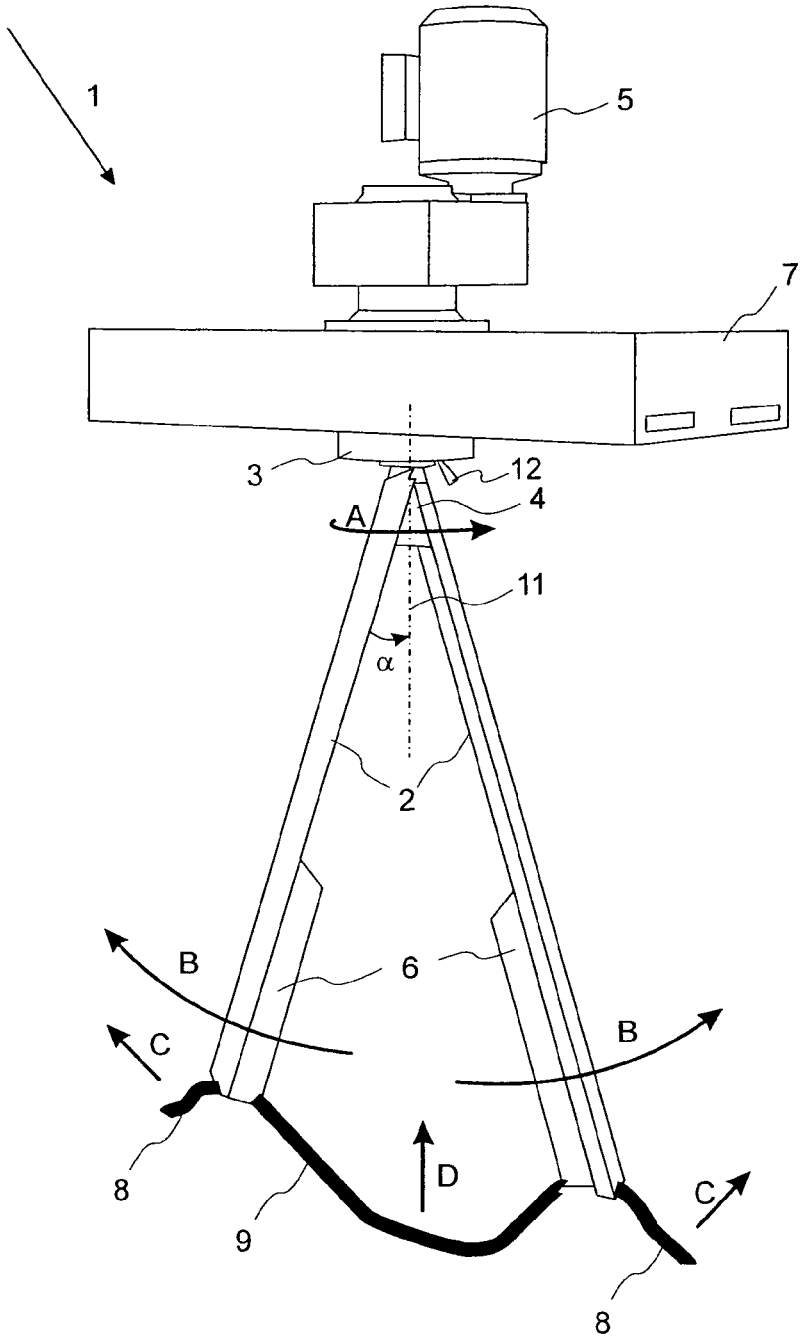
FIG. 2 shows an embodiment of the stirring installation according to the invention during rotation.

FIG. 2 shows an embodiment of the stirring installation according to the invention during rotation. The container 10 of FIG. 1 is not shown here for clarity reasons. The only difference to the embodiment of FIG. 1 is the arrangement of additional wings 6 at the blades 2. The wings extend in longitudinal direction of the blades 2. A single wing 6 arranged at only one blade or more than two wings 6 are also possible. The wings 6 are particularly replaceable by wings of different shape and/or size. They are advantageous for increasing the stirring effect for the liquid. Their shape and/or size may for example be chosen depending on a viscosity of the liquid, a required rotation speed and the power of the motor 5 used in the installation 1.

In the following, the operation of the stirring installation 1 will be described.

In a first step, the stirring installation 1 is positioned above the opening of the container 10, such that the blades 2 of the stirring means hang freely above the container opening.

In a second step, the stirring means are lowered into the container 10 through the opening. At this step, a particular advantage of using the support 7 becomes evident. As the container opening is normally relatively small, about 15 cm, the insertion of the stirring means into the container 10 may require a precise handling of the installation 1 in order to avoid damage to the opening or the blades 2. Particularly by using a carrier-pallet-like support, to which the motor 5 and the stirring means are attached, the stirring installation 1 may be moved in and out of its operating position, particularly by a pallet transporter, in a simple way.

In a third step, the motor 5 is actuated such that the coupling element 3 starts rotating the free hanging blades 2. The rotation is illustrated by the arrow A.

In a fourth step, the rotation is increased such that the blades 2 start pivoting around the bearing 4 because of the increasing centrifugal force. This is illustrated by the arrows B.

In a fifth step, the rotation speed is stabilized when the blades 2 have reached a given pivoting angle $\alpha$ with respect to a rotation axis 11.

A problem of ordinary solutions is that the blades 2 cannot be lowered to the bottom of the container 10 because of the shape of the container's bottom side. Containers normally have reinforcing ribs and different other protrusions on their bottom side. Thus, blades can only be positioned such as not to interfere with these protrusions. This results in a poor stirring effect of the product part located in the vicinity of the container bottom.

An advantageous embodiment of the present invention solves this problem by using the agitating means 8, 9 mentioned in the description of FIG. 1. During said acceleration process of the blades 2, the additional liquid agitating means 8, 9 are also subjected to the centrifugal force. The side chains 8 are lifted up, this being shown by the arrows C, and the central chain 9 is stretched as a result of the lifting blades 2, which is illustrated by the arrow D. As mentioned, the central chain 9 has to be loosely fixed to the second ends of the blades 2 in order to allow the blades 2 to lift up during rotation. The extent of how loose they are attached may depend on the maximum pivoting angle $\alpha$ of the blades 2. Thus, the chain length has to be at least the distance between the second ends of the blades 2 when lifted in the maximum pivoting angle $\alpha$. Preferably, the central chain 9 is dimensioned to be longer than this distance in order to increase the stirring effect. But, as a result of this construction, the central chain 9 may also be used to limit the maximum pivoting angle $\alpha$ as a security feature preventing a damage of the containers walls and/or the blades 2 in case the blades 2 would accidentally be rotated too fast and would reach the walls during rotation.

The blades 2 are particularly length-adjustable. They are particularly formed by at least two parts which can be pulled apart and pushed together. The adjustability of the blade's length is useful for the operation in all kind of containers. For example, if the container 10 is wider than deep, the blades 2 may be shortened as to adjust to the depth of the container 10 and it is then possible to increase the rotation speed, as the blades 2 would never touch the walls of the container 10. If the container 10 is deeper than wide, the blades 2 may be lengthened in order to reach the bottom area of the container 10, however the maximum rotation speed has to be limited.

The limitation of the rotation speed, which is typically around 40 rotations per minute, may be done by different means of which the choice of an appropriate length of the central chain 9 has already been mentioned. Apart of that, and in case there is no central chain 9 provided for the stirring means, the coupling element 3 may comprise at least an abutting member 12 for limiting the maximum pivoting angle $\alpha$ of the blades 2. During acceleration the blades 2 are lifted and they eventually abut against the abutting member 12 and cannot be lifted any further. Particularly, the abutting member 12 is also formed to allow an adjustment of the maximum pivoting angle $\alpha$, for example by designing it to be slidable. The pivoting angle $\alpha$ may also be adjusted depending on a number of revolutions per minute of the coupling element 3.

Another way of limiting the rotation speed is to control the motor's speed by means of a controller. This is known and will not be explained in more detail here.

The stirring installation 1 makes it possible to improve the quality of mixed liquids by stirring them thoroughly. At the same time it is flexible because it can be used in containers of different sizes. It also provides possibilities of adjusting a plurality of parameters in order to reach an optimum configuration for a given liquid to be stirred.

While there are shown and described presently preferred embodiments of the invention, it is to be distinctly understood that the invention is not limited thereto but may be otherwise variously embodied and practiced within the scope of the following claims.

The invention claimed is:

1. Stirring installation for stirring a liquid and/or a paste in a container, comprising an actuator and comprising a stirrer arranged inside the container, the stirrer comprising at least two blades, wherein the stirrer is rotatably coupled to the actuator by a coupling element in such a way that the blades are movably attached with a first end to at least a bearing of the coupling element, wherein, during a rotation of the coupling element, the blades are pivotable around the bearing due to the influence of the centrifugal force, wherein the stirrer further comprises a first additional liquid agitator, wherein the first additional liquid agitator comprises at least a side chain with one free end, and wherein the side chain is attached to a second end of the blade.

2. Stirring installation according to claim 1, wherein the stirrer further comprises a second additional liquid agitator comprising at least a central chain loosely connecting the second ends of two blades.

3. Stirring installation according to claim 1, wherein at least one of the blades comprises at least a wing extending in its longitudinal direction.

4. Stirring installation according to claim 1, wherein the coupling element comprises at least an abutting member for limiting a maximum pivoting angle of the blades.

5. Stirring installation according to claim 1, wherein the blades are replaceable.

6. Stirring installation according to claim 1, further comprising a support, and wherein the actuator and the stirrer are attached to the support.

7. Method for stirring a liquid and/or a paste in a container via a stirring installation comprising an actuator and comprising a stirrer arranged inside the container, the stirrer comprising at least two blades, wherein the stirrer is rotatably coupled to the actuator by a coupling element in such a way that the blades are movably attached with a first end to at least a bearing of the coupling element, wherein the stirrer further comprises a first additional liquid agitator, wherein the first additional liquid agitator comprises at least a side chain with one free end, and wherein the side chain is attached to a second end of the blade, the method comprising steps of:

positioning the stirring installation above an opening of the container, such that the blades of the stirrer hang above the opening of the container, lowering the stirrer into the container through the opening, actuating the actuator such that the coupling element starts rotating the blades, increasing the rotation such that the blades start pivoting around the bearing because of an increasing centrifugal force, and stabilizing the rotation speed when the blades have reached a given pivoting angle with respect to a rotation axis.

8. Method according to claim 7, wherein the pivoting angle is adjusted depending on a number of revolutions per minute of the coupling element.

9. Method according to claim 7, wherein a chain length of the central chain is chosen to be at least a distance between second ends of the blades when lifted in the maximum pivoting angle.

* * * * *